US010022001B1

(12) United States Patent
Hawkins

(10) Patent No.: US 10,022,001 B1
(45) Date of Patent: Jul. 17, 2018

(54) INFLATABLE PILLOW OR HEADREST

(71) Applicant: W. Brooke Hawkins, Alpharetta, GA (US)

(72) Inventor: W. Brooke Hawkins, Alpharetta, GA (US)

( * ) Notice: Subject to any disclaimer, the term of this patent is extended or adjusted under 35 U.S.C. 154(b) by 265 days.

(21) Appl. No.: 15/015,344

(22) Filed: Feb. 4, 2016

Related U.S. Application Data

(60) Provisional application No. 62/114,330, filed on Feb. 10, 2015.

(51) Int. Cl.

| | |
|---|---|
| ***A47G 9/10*** | (2006.01) |
| ***A47C 7/38*** | (2006.01) |
| ***A47C 7/42*** | (2006.01) |
| *A47G 9/00* | (2006.01) |

(52) U.S. Cl.
CPC ..... *A47G 9/1027* (2013.01); *A47C 7/383* (2013.01); *A47C 7/42* (2013.01); *A47G 9/1072* (2013.01); *A47G 2009/003* (2013.01)

(58) Field of Classification Search
CPC ..... A47G 9/10; A47G 9/1009; A47G 9/1027; A47G 9/1072; A47G 9/1081; A47G 9/109; A47G 2009/003; A47C 7/383; A47C 7/42
See application file for complete search history.

(56) References Cited

U.S. PATENT DOCUMENTS 1,382,831 A * 6/1921 Hilker ..... A47C 27/081 383/3
2,612,645 A * 10/1952 Boland ..... A47C 20/048 297/DIG. 3
2,877,472 A * 3/1959 Wagner ..... A47G 9/10 5/636
3,251,075 A * 5/1966 Saltness ..... A47C 27/081 383/3
3,555,582 A * 1/1971 Radford ..... A47C 20/027 297/230.1
3,602,928 A * 9/1971 Helzer ..... A47G 9/10 5/490
3,644,949 A * 2/1972 Diamond ..... A47C 20/04 5/630
4,242,767 A * 1/1981 McMullen ..... A63H 33/062 297/452.16
4,255,824 A * 3/1981 Pertchik ..... A47G 9/10 297/452.41
5,005,702 A * 4/1991 Davis ..... A47B 23/002 108/43
5,168,590 A * 12/1992 O'Sullivan ..... A47G 9/0253 5/421

(Continued)

*Primary Examiner* — Robert G Santos
*Assistant Examiner* — David R Hare
(74) *Attorney, Agent, or Firm* — Lee & Hayes, PLLC; Charles L. Warner

(57) ABSTRACT

A pillow 10 has two side panels (15A, 15B), an inner wedge (20) positioned between and connected to the two side panels, a mesh (25), and at least one valve stem (30). The inner wedge is enclosed by the side panels and the mesh. When the side panels and the inner wedge are inflated they become rigid and hold the mesh taut. The mesh allows air to circulate around the head of the user when the user lays his or her head on the pillow. There may be a single valve stem, in which case there are passageways between the side panels and the inner wedge to allow air to flow between them. There may also be two or three valve stems, and one or no passageways.

20 Claims, 10 Drawing Sheets

(56) References Cited

U.S. PATENT DOCUMENTS 5,214,816 A * 6/1993 Collins ..... A47C 16/005 5/633
5,231,720 A * 8/1993 Benoff ..... A47C 27/081 5/638
5,335,382 A * 8/1994 Huang ..... A43B 13/203 297/199
5,396,674 A * 3/1995 Bolds ..... A47C 20/027 5/630
5,697,112 A * 12/1997 Colavito ..... A47C 20/027 5/490
5,771,514 A * 6/1998 Wilhoit ..... A47G 9/1027 5/421
6,175,979 B1 * 1/2001 Jackson ..... A47C 20/021 5/648
7,100,227 B2 * 9/2006 Frisbee ..... A47G 9/10 5/490
D587,507 S * 3/2009 Martin ..... D6/604
7,578,015 B1 * 8/2009 Wilson ..... A47G 9/1036 5/636
8,572,780 B1 * 11/2013 Watters ..... A47G 9/1054 5/490
8,925,721 B2 * 1/2015 Young ..... A45F 5/10 206/320
D767,148 S * 9/2016 Perreault ..... D24/183
2003/0159218 A1 * 8/2003 Lin ..... A47C 4/54 5/710
2005/0072893 A1 * 4/2005 Brown ..... A47B 23/002 248/444
2011/0173754 A1 * 7/2011 Calder ..... A47G 9/1027 5/644
2012/0204350 A1 * 8/2012 Katsnelson ..... A47G 9/1027 5/644
2014/0201918 A1 * 7/2014 Ordonez ..... A47G 9/1009 5/643
2016/0106225 A1 * 4/2016 Ham ..... A47C 27/082 5/655.3

* cited by examiner

INFLATABLE PILLOW OR HEADREST

CROSS-REFERENCE TO RELATED APPLICATION

This application claims the priority of U.S. Provisional Patent Application No. 62/114,330, filed Feb. 10, 2015, entitled "Inflatable Pillow Or Headrest," the entire disclosure and contents of which are hereby incorporated by reference herein.

SUMMARY

An inflatable pillow which allows air to circulate around the user's head is described.

DETAILED DESCRIPTION

The following Detailed Description is directed to technologies for an inflatable pillow or headrest assembly. The inflatable pillow or headrest allows air to circulate around the head of the user, thereby providing cooling and comfort.

When a user places his or her head on a conventional plastic pillow or headrest, the user's head, and possibly the user's neck, is in contact with a non-permeable plastic sheet or surface. This plastic sheet does not allow air to circulate around the user's head and/or neck, so the user quickly experiences a sensation that the pillow is warm. More particularly, the user feels that his or her head and/or neck are warm and, generally, the user is not as comfortable as desired.

Figure 1A:
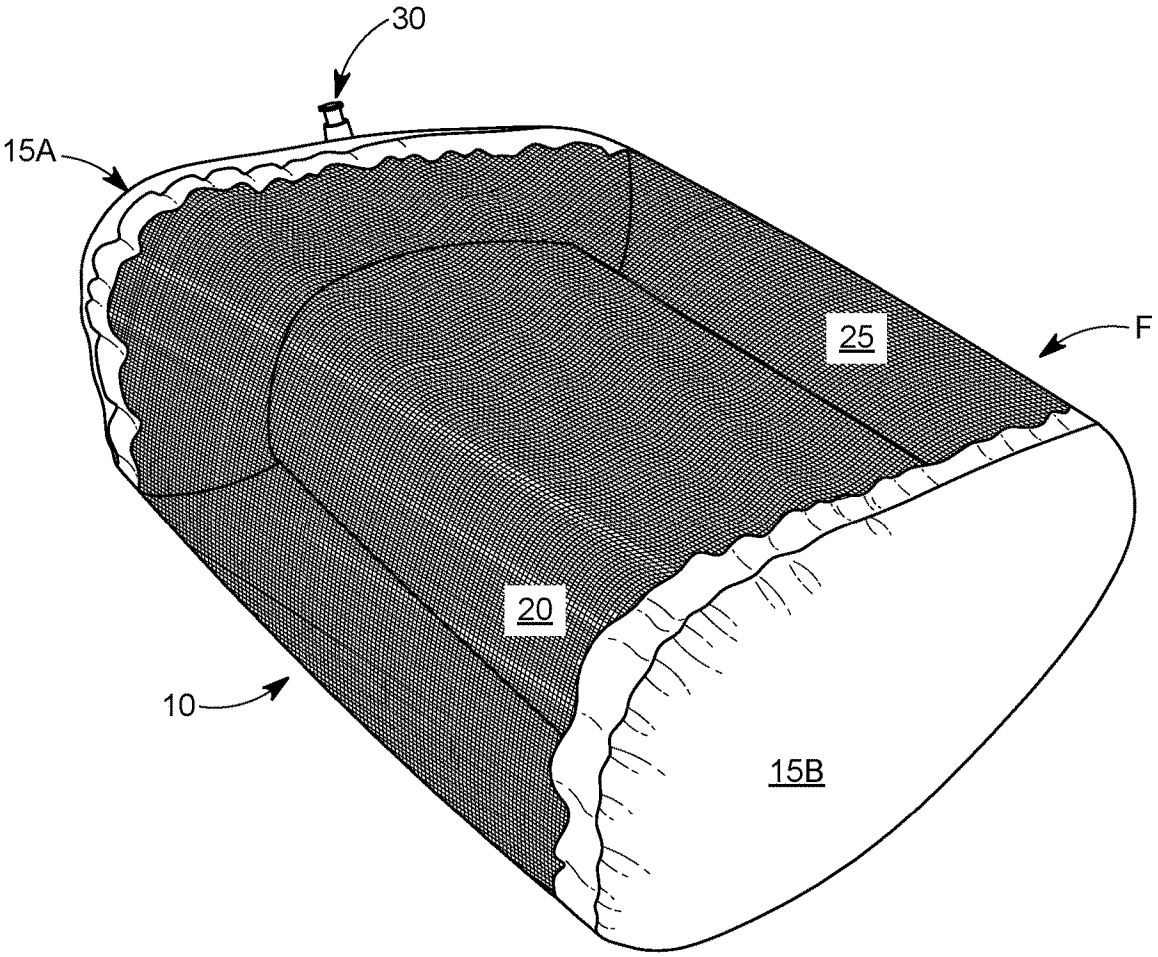
FIG. 1A is a perspective illustration showing one exemplary embodiment of a pillow.
Figure 1B:
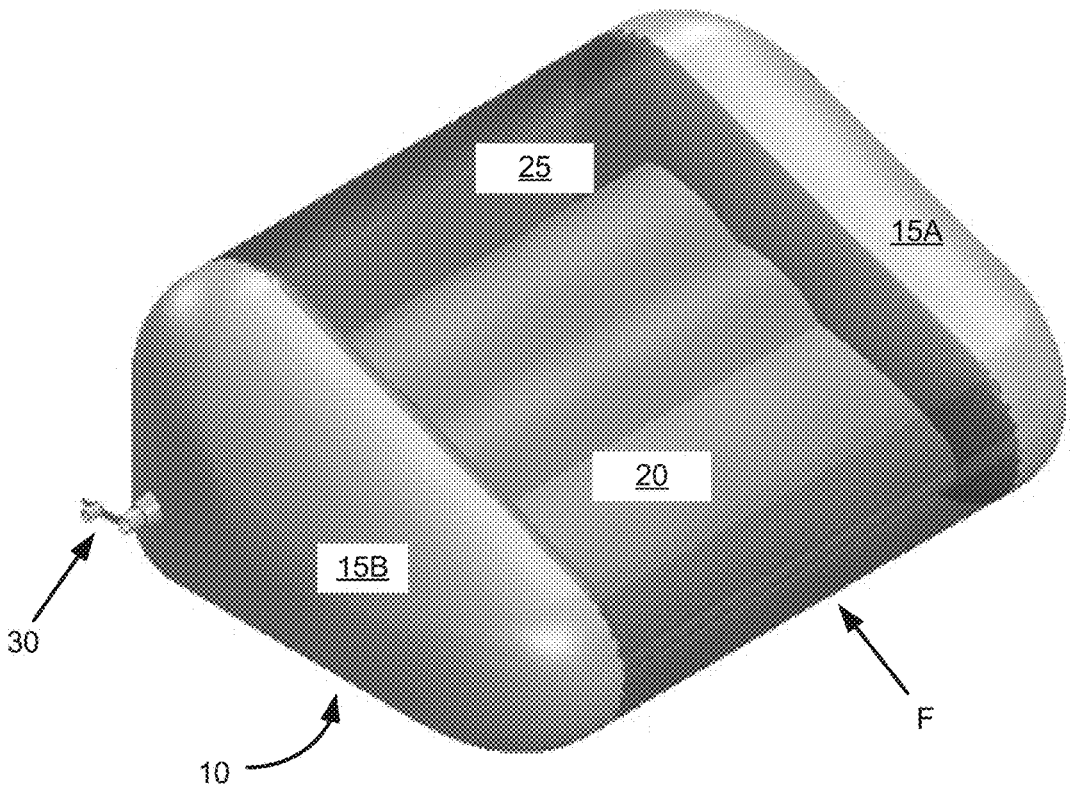
FIG. 1B is a perspective illustration showing another exemplary embodiment of a pillow.

FIG. 1A is a perspective illustration showing one exemplary embodiment of a pillow 10 and FIG. 1B is a perspective illustration showing another exemplary embodiment of a pillow 10. The pillow 10 may be considered to be a headrest and may be referred to as such. The pillow 10 has a wedge shape. The wedge shape provides the head and neck of user with an elevated position to provide comfort and visibility, and the open, mesh design provides for air circulation to prevent sweat and overheating.

As shown in FIGS. 1A-1G, the pillow 10 consists of separated inflatable side panels 15A, 15B which are connected by at least one inflatable internal tube, referred to herein as an inner wedge 20. A mesh 25 is disposed between the side panels 15A, 15B. At least one valve stem 30 allows for the side panels 15A, 15B and inner wedge 20 to be inflated or deflated, as desired. The "F" reference indicates the front edge of the pillow 10.

Figure 1C:
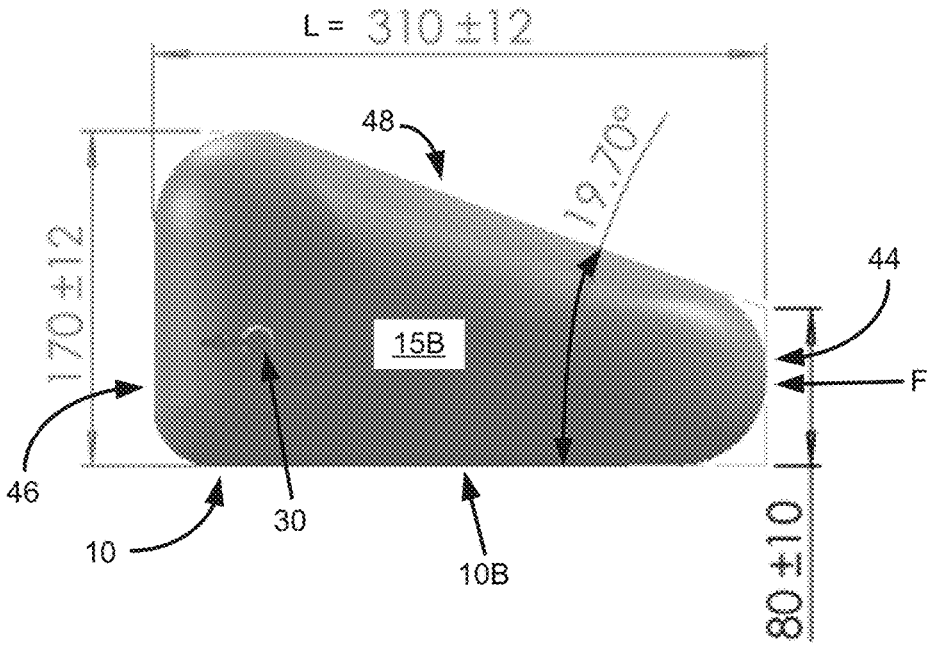
FIG. 1C is a left side elevation view of the exemplary pillow of FIG. 1B.

FIG. 1C is a left side elevation view of the exemplary pillow 10 of FIG. 1B. FIG. 1C shows an exemplary front edge 44 height of approximately 3.15 inches (80±10 millimeters), an exemplary rear edge 46 height of approximately 6.7 inches (170±12 millimeters), a length L of approximately 12.2 inches (310±12 millimeters), and a front-to-back upward sloped surface 48 of the mesh 25 of approximately 19.70 degrees.

Figure 1D:
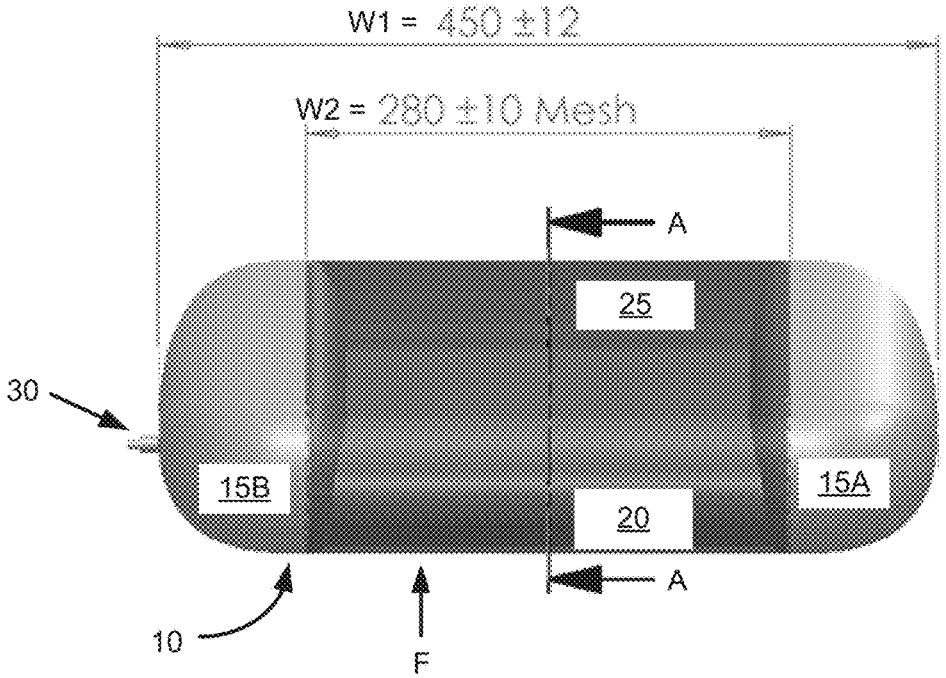
FIG. 1D is a front elevation view of the exemplary pillow of FIG. 1B.

FIG. 1D is a front elevation view of the exemplary pillow 10 of FIG. 1B. FIG. 1D shows an exemplary overall width W1 of approximately 17.7 inches (450±12 millimeters), with the screen or mesh 25 having a width W2 of approximately 11 inches (280±10 millimeters). Cutaway lines A-A are also shown.

Figure 1E:
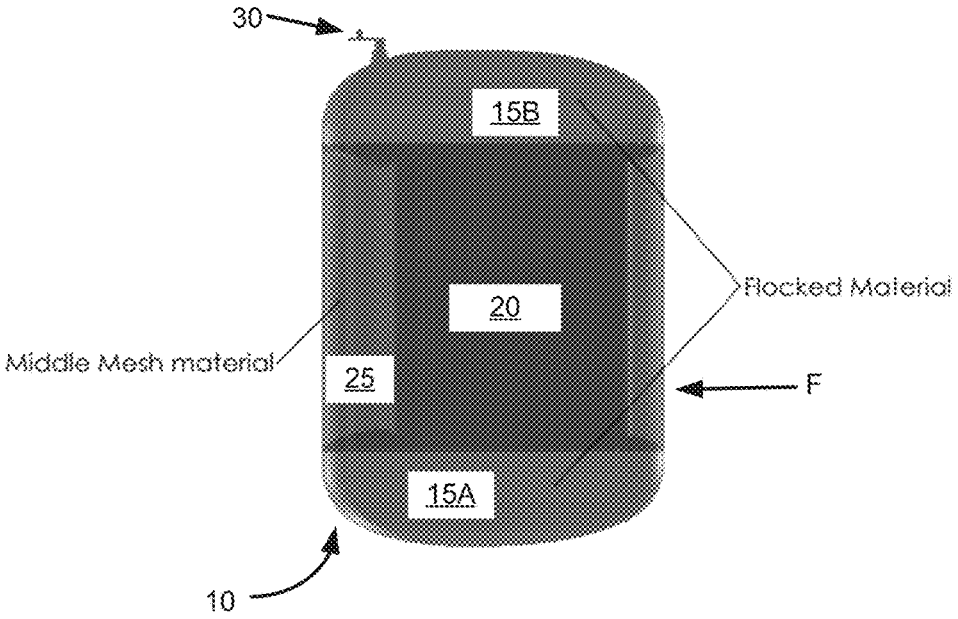
FIG. 1E is a bottom view of the exemplary pillow of FIG. 1B.

FIG. 1E is a bottom view of the exemplary pillow 10 of FIG. 1B. FIG. 1E also indicates that the side panels 15A and 15B may optionally be made of a flocked material.

Figure 1F:
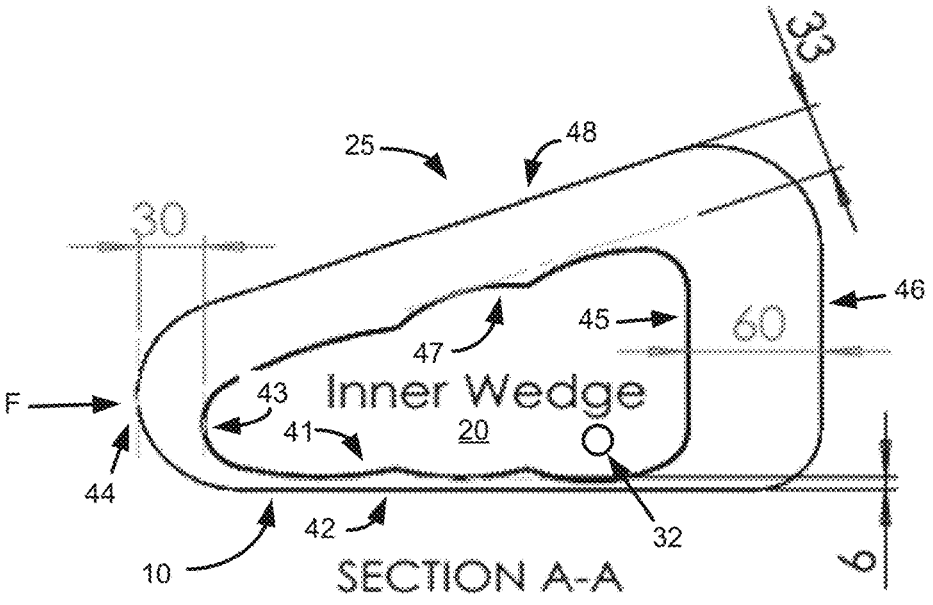
FIG. 1F is cutaway view along lines A-A of FIG. 1D.

FIG. 1F is cutaway view along lines A-A of FIG. 1D. FIG. 1F shows that the bottom surface 41 of the inner wedge 20 is approximately ¼ inch (6 millimeters) above the bottom surface 42 of the pillow 10, the front edge 43 of the inner wedge 20 is set back from the front edge 44 of the pillow 10 by approximately 1 3/16 inch (30 millimeters), the rear edge 45 of the inner wedge 20 is set forward of the rear edge 46 of the pillow 10 by approximately 2⅜ inches (60 millimeters), and that the sloped surface 47 of the inner wedge 20 is separated from the sloped surface 48 of the mesh 25 by approximately 1¼ inches (33 millimeters). These dimensions are exemplary and are not critical.

For example, in another implementation, the rear edge 46 of the pillow 10 is approximately seven inches (178 millimeters) in height and the front edge 44 of the pillow 10 is approximately three inches (76 millimeters) in height. These dimensions also provide a height and a slope which elevate the head and neck to a comfortable position, and also allow for comfort and convenience when, for example, reading a book or magazine, or viewing a portable electronic device. As previously stated, these dimensions are exemplary and are not critical.

Making the pillow 10 too high or making the slope too steep may result in the pillow 10 being less comfortable to the user. Similarly, making the pillow 10 too shallow, or making the slope too small may result in the pillow 10 being less comfortable to the user. Also, making the pillow 10 too wide may unnecessarily increase the material costs of the pillow 10, may increase the amount of time and effort required by the user to inflate the side panels 15A, 15B, and inner wedge 20, and may result in the pillow 10 sagging too much when the user's head 50 is on the pillow 10. Making the pillow 10 too narrow, however, may decrease the air flow and provide less cooling for the head of the user. Further, making the pillow 10 too long (front-to-back) may unnecessarily increase the material costs of the pillow 10, may increase the amount of time and effort required by the user to inflate the side panels 15A, 15B, and inner wedge 20, and may result in the pillow 10 providing less than optimal support for the user's head and neck. Making the pillow 10 too short, however, may decrease the air flow, provide less cooling for the head 50 of the user, and provide less than optimal support for the user's head and neck.

The side panels 15A, 15B and inner wedge 20, when inflated, provide some rigidity to the pillow 10 so that the mesh 25 supports the user's head when the user rests his or her head on the mesh 25.

Figure 1G:
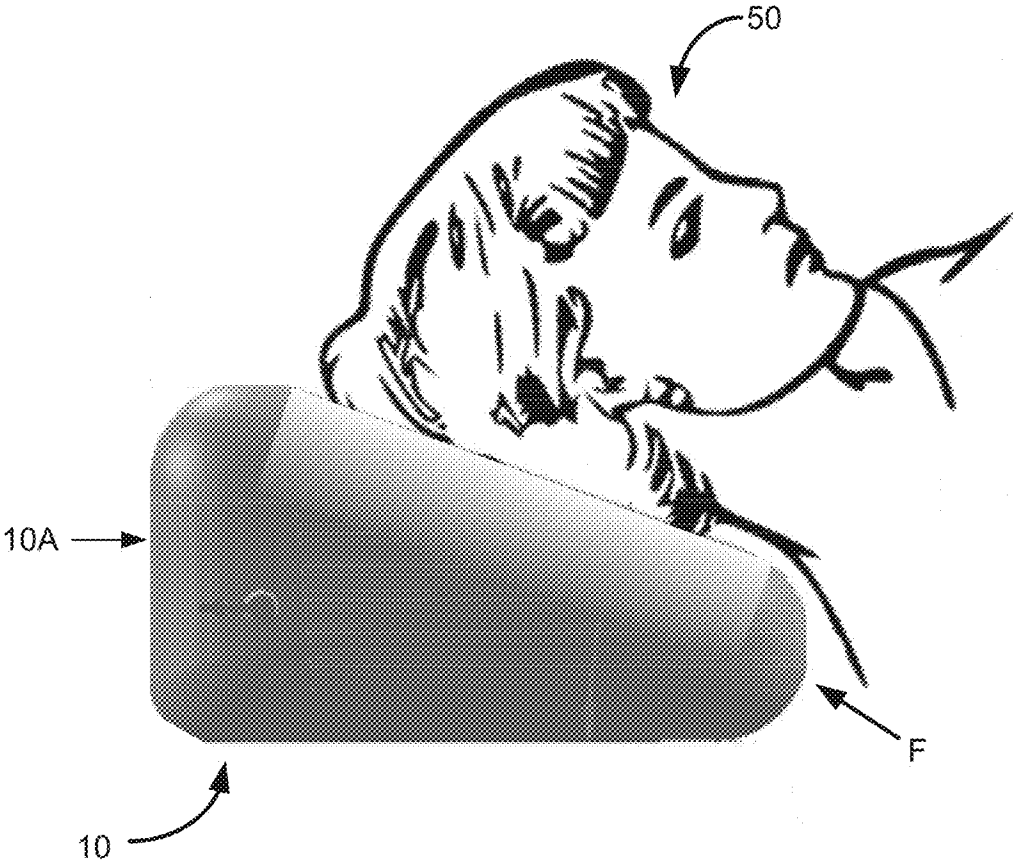
FIG. 1G is an illustration of a person laying on the exemplary pillow of FIG. 1B.

FIG. 1G is an illustration of a person laying on the exemplary pillow 10 of FIG. 1B. When the user 50 places his or her head on the inflated pillow 10, as shown in FIG. 1G, the mesh 25 supports the user's head away from the inner wedge 20 (best seen in FIGS. 1A, 1E, and 1F). This allows air to circulate around the head of the user 50, thereby eliminating, or at least reducing, the sensation of heat that a user would feel if the user 50 had rested his or her head on a conventional plastic pillow. The inner wedge 20 also provides a supporting or limiting surface for the mesh 25 when the mesh 25 is not able to fully support the weight of the user's head, such as if the side panels 15A, 15B are not sufficiently inflated to keep mesh 25 reasonably taut under the load of the user's head.

Although only one valve stem 30 is shown, one could provide for separate valve stems 30 for each side panel 15A, 15B and/or the inner wedge 20. Also, the valve stem 30 or valve stems 30 could be placed as desired so long as the placement allowed for air to be pushed into the side panels 15A and 15B and the inner wedge 20. For example, FIG. 1A shows a valve stem 30 being located toward the middle (front-to-back), and toward the top, of side panel 15A. FIGS. 1B-1E and 1G, however, show a valve stem 30 being located toward the rear, and toward the middle (bottom-to-top), of side panel 15B. If only one valve stem 30 is used, such as in a side panel 15A or 15B, then there is a passageway 32 (see FIG. 1F) between the side panel 15A and the inner wedge 20, and another passageway between the inner wedge 20 and the other side panel 15B. Thus, putting air into either side panel 15A or 15B inflates both side panels 15A and 15B and the inner wedge 20. Although the passageway 32 is depicted as being a relatively small passageway it may be larger if desired, even to the point that the interior of the inner wedge 20 is completely open to the side panel 15A or 15B, rather than being open only via a small opening. If two valve stems 30 are used, such as one valve stem 30 in side panel 15A and another valve stem 30 in side panel 15B, then the inner wedge 20 may have just one passageway so that the inner wedge 20 is inflated when the connected (via the passageway 32) side panel is inflated. If three valve stems 30 are used, e.g., one valve stem 30 in each of side panel 15A, side panel 15B, and inner wedge 20, then there might not be any passageways.

For convenience of construction, the mesh 25 may go completely around the pillow 10, so that it does not matter which side of the pillow 10 is toward the user and which side is toward the ground or other supporting surface. If desired, however, such as for increased durability, the bottom surface 42 of the pillow 10 could be a sheet, such as a plastic sheet, rather than a mesh. This would not have a significant effect on the cooling aspects of the pillow 10 as that part of the pillow 10 would, in normal use, be in contact with the ground or other surface which does not provide for air flow.

The pillow 10 is preferably, but not necessarily, made from vinyl or another strong, durable plastic material. The side panels 15A, 15B and the inner wedge 20 are preferably, but not necessarily, in a single molded structure. They can also be made as more or individual components and then fused or glued together. The mesh 25 is preferably, but not necessarily, fused or glued to the side panels.

The pillow 10 may be used in various locales, such as, but not limited to, the beach, pool, traveling on airplanes, cars, boats, recreational vehicles (RV's), camping, or simply at home. The pillow 10 provides support and comfort to a person's head, neck and shoulders. The pillow 10 may be inflated by mouth, or by a small air compressor or manual air pump, via the valve stem 30. The valve stem 30 is preferably, but not necessarily, of the type commonly found on other inflatable devices for recreational use.

The mesh 25 may be, by way of example and not of limitation, a vinyl, nylon or suede mesh netting which provides for airflow through the pillow to reduce or eliminate overheating of the head, neck and shoulder areas.

A generally wedge-shaped design, as shown, is preferred. The pillow 10 can be made, however, in other shapes, as desired, such as, when viewed from the side, in the shape of a round tube, in the shape of an oval tube, in the shape of a rectangle, etc. Some shapes may, however, be less desirable from the viewpoint of comfort and cooling.

The pillow 10 is also useful in other situations. For example, if a user has a limb which is heat-sensitive, such as a sunburned arm, then placing that arm on a non-breathable surface, such as even a soft pillow, which holds in heat, may be uncomfortable for the user. Also, if a user has a seriously injured limb, such as due to fire, chemical burn, abrasion, etc., then airflow around that limb often provides comfort to the user and helps in the healing process. The pillow 10 allows air to circulate around that limb, thereby cooling that limb and providing comfort to the user.

The pillow 10 is also useful as for traveling. The pillow 10 can be inflated for use as a headrest when flying or even for trips by an automobile or bus. When not in use, the pillow 10 can be deflated so as to minimize its volume and allow for convenient carrying by hand, in a purse, in a briefcase, etc. Further, the pillow 10 keeps the head of the user from contacting the built-in headrest on the seat of an airplane, train, or bus, and the pillow 10 can be easily and thoroughly washed just using soap and water. This reduces the likelihood that the user will be exposed to and suffer from head lice or diseases which may be carried by human secretions, such as but not limited to sweat.

The wedge shaped design provides comfort and ease of elevation of head, neck and shoulders. The material from which the side panels 15A, 15B, inner wedge 20, and mesh 25 may be made of different colored materials, if desired, for aesthetic purposes and/or to reduce sunlight absorption and heating when the pillow 10 is used outside. The pillow, or components thereof, may be made in any desirable color but, preferably, are made in a light color so that, when in sunlight, they do not absorb the sunlight and get warm. A flocked vinyl construction provides aesthetics, strength, and durability for long use. Vinyl, suede, or nylon mesh may cover the entire pillow to provide constant airflow or circulation to prevent overheating or sweating of the head, neck or shoulder area. The pillow 10 may be inflated by mouth by use of a retractable valve stem 30. Deflation is easily accomplished by removing the plug (not separately numbered) from the tube of the stem 30, and then squeezing the valve stem 30 and the pillow 10 until all, or as much as is desired, of the air is removed. Strings or a band (not shown) may be affixed as part of the pillow or may be separate. Strings or bands allow the user to secure the pillow 10 in a rolled or folded manner for easy storage until next use. The pillow 10, preferably being made of a plastic material, can get wet without being damaged. For example, it can be used at the beach.

Figure 2A:
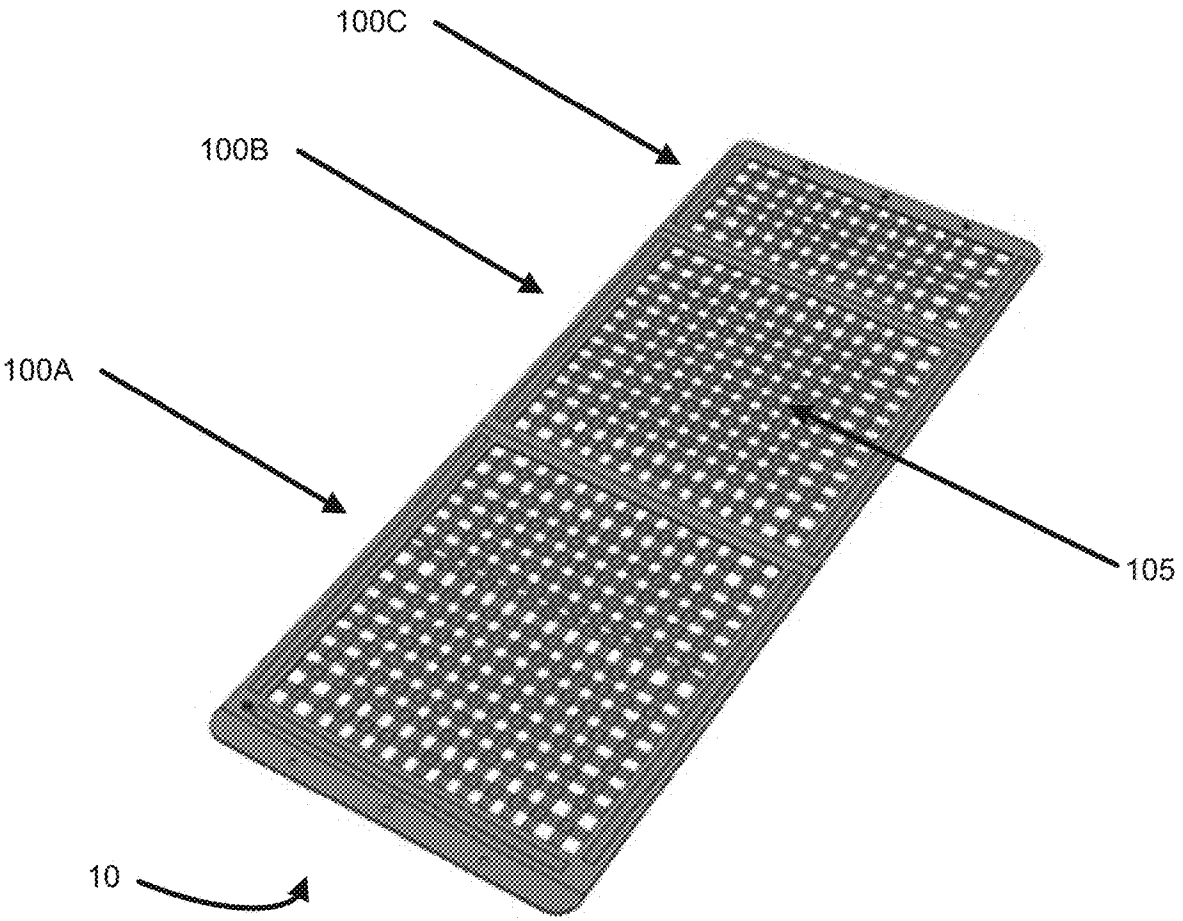
FIG. 2A illustrates one view of another exemplary pillow in an expanded (unfolded) position.
Figure 2B:
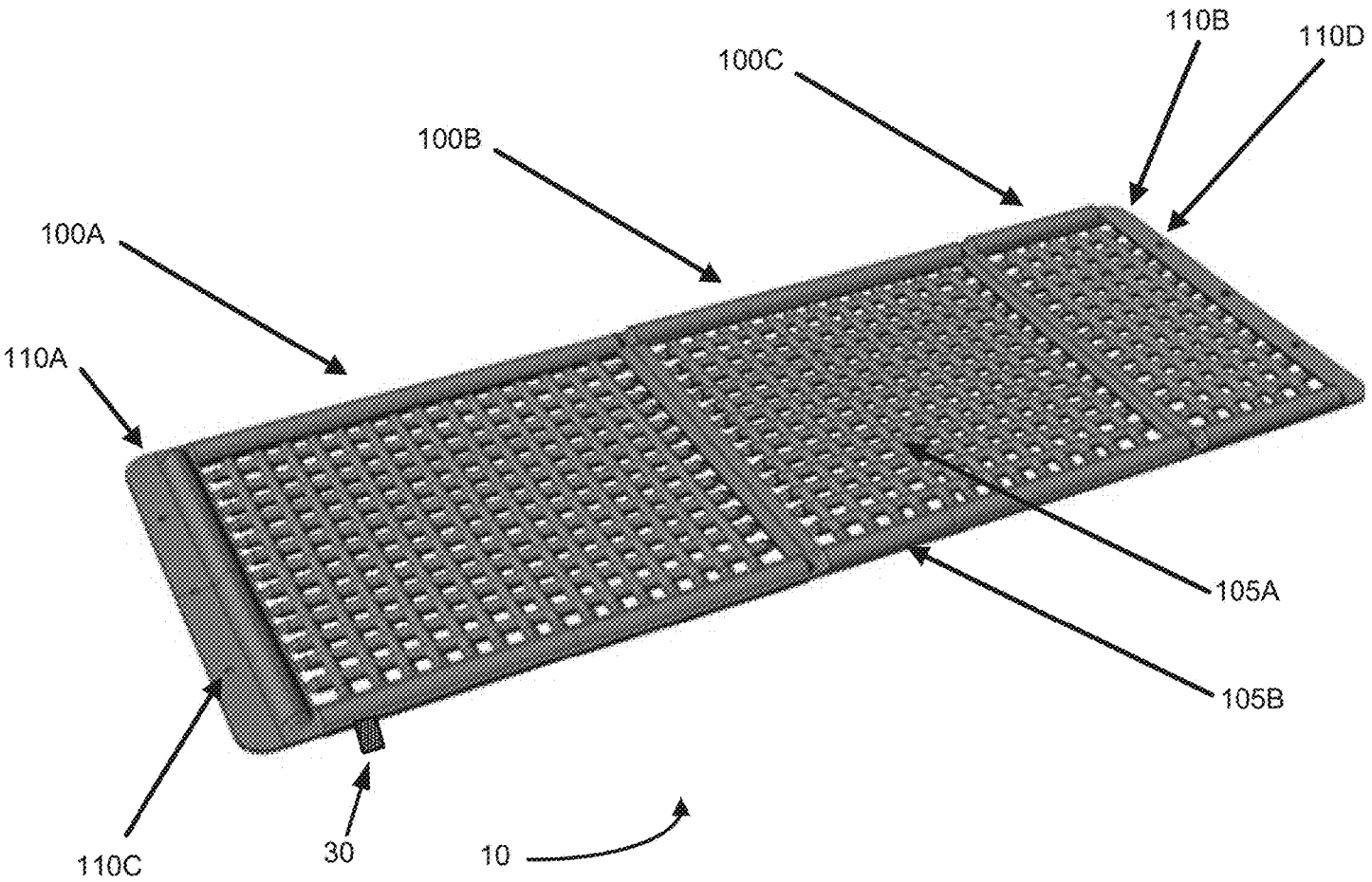
FIG. 2B illustrates another view of the exemplary pillow of FIG. 2A in the expanded position.

FIGS. 2A-2E illustrate another embodiment of an inflatable pillow or headrest 10. FIG. 2A illustrates one view of another exemplary pillow 10 in an expanded (unfolded) position. FIG. 2B illustrates another view of the exemplary pillow 10 of FIG. 2A in the expanded position. As shown in FIGS. 2A and 2B, there are preferably three sections, 100A, 100B, and 100C. Each section 100A, 100B, 100C comprises a plurality of interconnected and internal inflatable tubes 105A and external inflatable tubes 105B. Each section 100A, 100B, 100C preferably, but not necessarily, has its own valve stem 30 for inflating and deflating. Alternatively, one or two panels which do not have a valve stem 30 can be connected via one or more passageways to a panel which does have a valve stem 30. Also shown are fasteners 110A and 110B. The fasteners 110A, 110B may be, by way of example and not of limitation, plastic strips with one strip having pegs 110C and the other strip having holes 110D into which the pegs 110C are inserted, or may be plastic strips with hook-and loop-type fasteners, such as Velcro™.

Figure 2C:
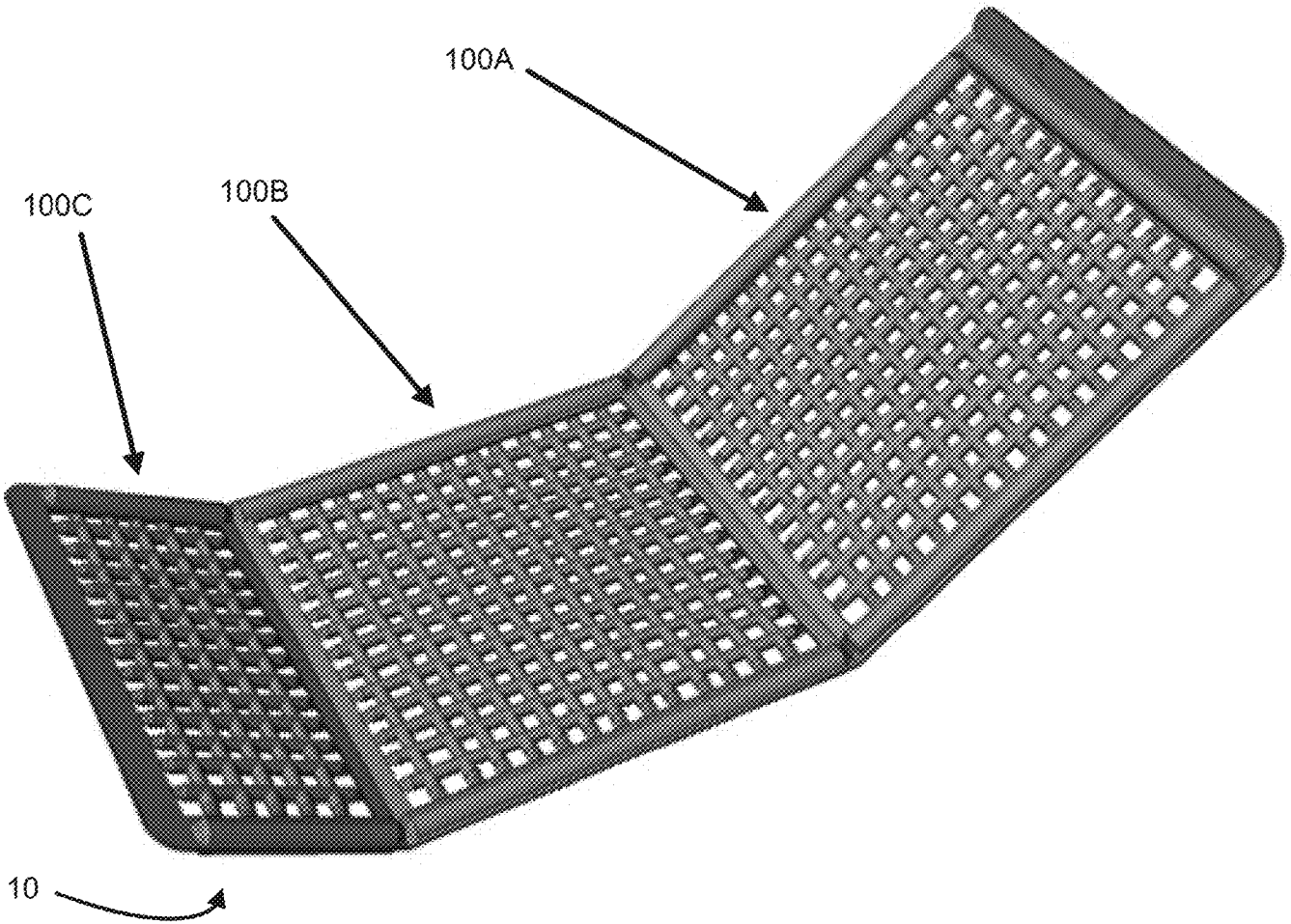
FIG. 2C illustrates a view of the exemplary pillow of FIG. 2A in a partially folded position.
Figure 2D:
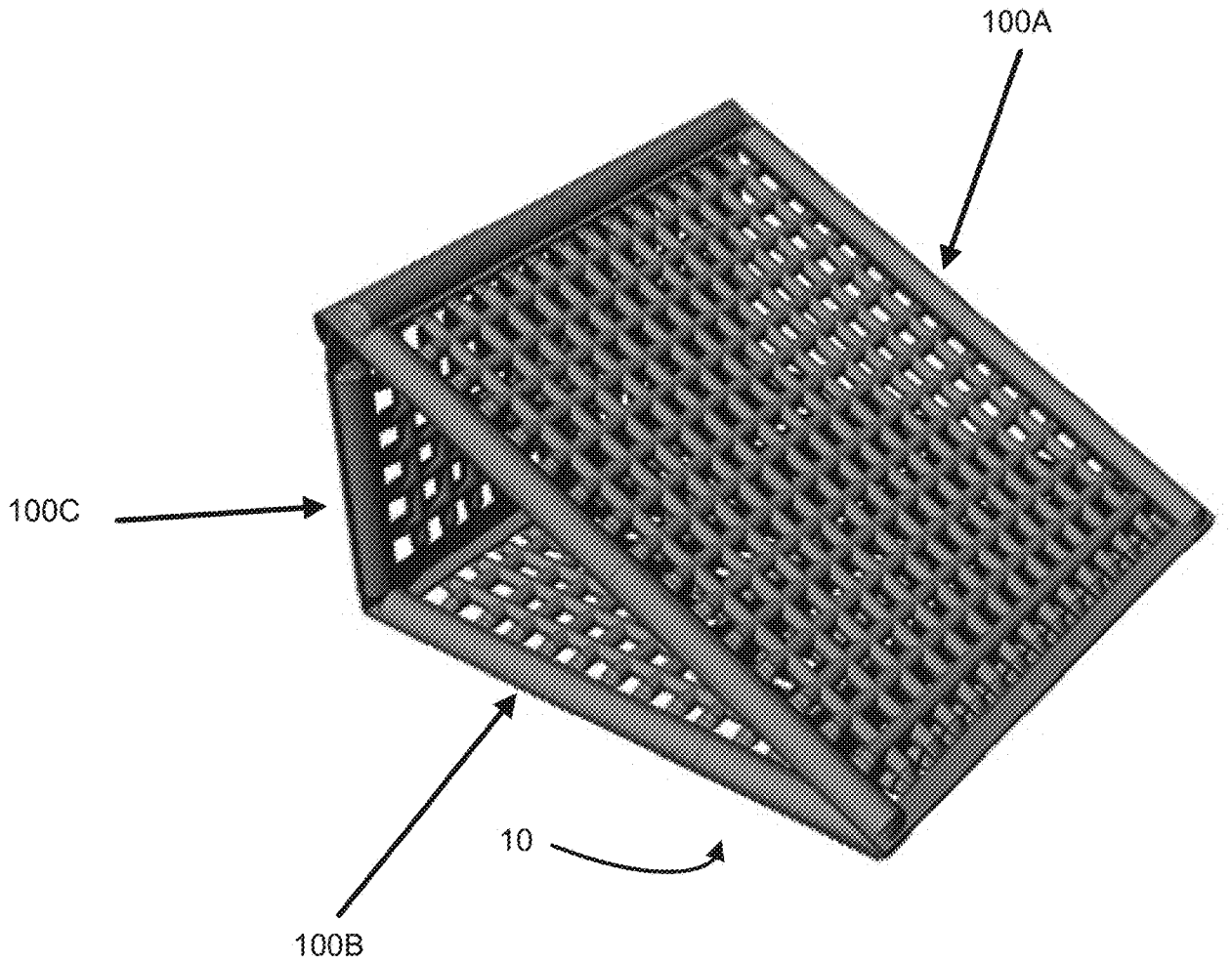
FIG. 2D illustrates a view of the exemplary pillow of FIG. 2A in a fully folded position.
Figure 2E:
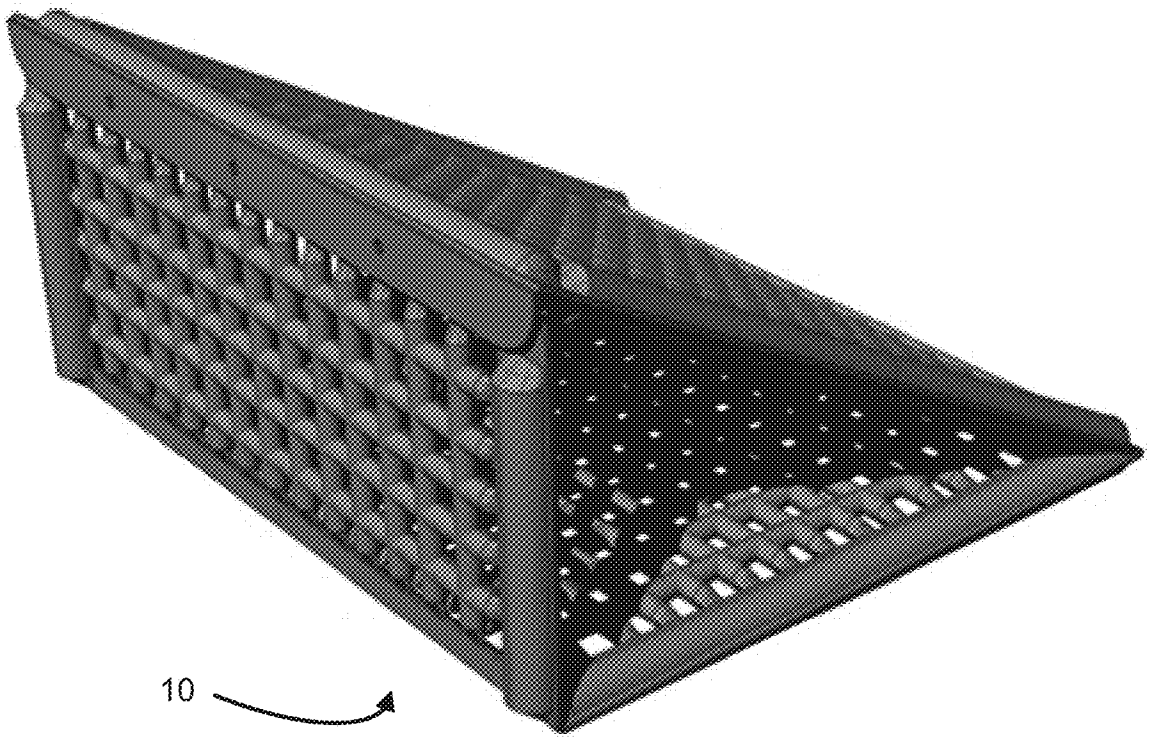
FIG. 2E illustrates another view of the exemplary pillow of FIG. 2A in a fully folded position.

FIG. 2C illustrates a view of the exemplary pillow 10 of FIG. 2A in a partially folded position. FIG. 2D illustrates a view of the exemplary pillow 10 of FIG. 2A in a fully folded position. FIG. 2E illustrates another view of the exemplary pillow 10 of FIG. 2A in a fully folded position. As shown in FIGS. 2C and 2D, the three sections are folded to form the headrest 10. As shown in FIGS. 2D and 2E, the fasteners 110A, 110B hold the headrest 10 in the folded position.

Optionally, a section, such as, and preferably, but not limited to section 100A or 100B, may have the external inflatable tubes 105B but, instead of internal inflatable tubes 105A, may have a plastic mesh, such as mesh 25 of FIGS. 1A-1G, to support the user's head and allow air to circulate around the user's head. Optionally, the external inflatable tubes 105B may be replaced by a lightweight metal frame, and the internal inflatable tubes 105A may be replaced by a plastic mesh.

Although the inflatable tubes 105A are illustrated as being in a criss-cross repeating pattern, and as being connected to the inflatable tubes 105B a right angles, that is merely a preference. The inflatable tubes may be connected to the inflatable tubes 105B at another desired angle, such as 30 degrees, 45 degrees, 60 degrees, etc. Also, the inflatable tubes 105A may be in a pattern other than a criss-cross pattern. Complex patterns, however, may increase the cost, difficulty, and complexity of manufacturing.

Although the fastener 110A is shown as being joined to or part of a long panel 100A, and the fastener 110B is shown as being joined to or part of a short panel 100C, and 110B, that is merely one embodiment. For example, the short panel 100C could be between and attached to the two long panels 100A and 100B, and the fasteners 110A and 110B could at the opposing, free ends of the long panels 100A and 100B, so that the long panels 100A and 100B can be releasably joined together by the fasteners 110A, 110B.

Based on the foregoing, it should be appreciated that different embodiments of an inflatable pillow have been disclosed herein. The inflatable pillow provides better cooling, support, and/or comfort than conventional pillows. Although the subject matter presented herein has been described in language specific to the embodiments disclosed herein, it is to be understood that the concepts disclosed herein are not necessarily limited to the specific embodiments and components described herein. Rather, the specific embodiments, components, and dimensions are disclosed as examples. For example, although air has been described as being used to inflate the various components, any desired and appropriate (non-flammable, non-hazardous, non-corrosive, non-explosive) gas may be used, such as but not limited to nitrogen, carbon dioxide, etc.

The subject matter described herein is provided by way of illustration for the purposes of teaching, suggesting, and describing, and not limiting or restricting. Combinations and alternatives to the illustrated embodiments are contemplated, described herein, and set forth in the claims. Various modifications and changes may be made to the subject matter described herein without strictly following the embodiments and applications illustrated and described, and without departing from the scope of the following claims.

I claim:

1. A pillow, comprising:

a first inflatable side panel;

a second, opposing, inflatable side panel;

an inflatable tube joined to the first inflatable side panel and the second inflatable side panel, and disposed between the first inflatable side panel and the second inflatable side panel;

a mesh joined to the first inflatable side panel and the second inflatable side panel, and disposed between the first inflatable side panel and the second inflatable side panel;

a bottom surface joined to the first inflatable side panel and the second inflatable side panel, and disposed between the first inflatable side panel and the second inflatable side panel;

wherein the inflatable tube is enclosed within a volume defined by the first inflatable side panel, the second inflatable side panel, the mesh, and the bottom surface;

a valve stem in at least one of the first inflatable side panel, the second inflatable side panel, or the inflatable tube;

a first passageway between the first inflatable side panel and the inflatable tube to allow air to flow from one of the first inflatable side panel and the inflatable tube into the other of the first inflatable side panel and the inflatable tube; and a second passageway between the second inflatable side panel and the inflatable tube to allow air to flow from one of the second inflatable side panel and the inflatable tube into the other of the second inflatable side panel and the inflatable tube.

2. The pillow of claim 1 wherein the first inflatable side panel and the second inflatable side panel each have a front end and a rear end, the rear end is taller than the front end, and the first inflatable side panel and the second inflatable side panel each have a wedge shape.

3. The pillow of claim 1 wherein the inflatable tube has a front end and a rear end, the rear end is taller than the front end and the inflatable tube has a wedge shape.

4. The pillow of claim 1 wherein the first inflatable side panel and the second inflatable side panel suspend the tube so that the tube is not in contact with the mesh.

5. The pillow of claim 1 wherein the first inflatable side panel and the second inflatable side panel suspend the tube so that the tube is not in contact with the mesh or the bottom surface.

6. The pillow of claim 1 wherein the bottom surface is a continuation of the mesh.

7. The pillow of claim 1 wherein the bottom surface is a plastic sheet.

8. The pillow of claim 1 and further comprising a plurality of inflatable tubes disposed between the first inflatable side panel and the second inflatable side panel, the first inflatable tube being one of the plurality of inflatable tubes, the first inflatable side panel and the second inflatable side panel being connected by the inflatable tubes of the plurality of inflatable tubes.

9. The pillow of claim 1 wherein the first inflatable side panel, the second inflatable side panel, and the inflatable tube are molded as a unitary structure.

10. The pillow of claim 1 wherein the mesh is fused or glued to the first inflatable side panel and the second inflatable side panel.

11. A pillow, comprising:

a first inflatable side panel;

a second, opposing, inflatable side panel;

an inflatable tube joined to the first inflatable side panel and the second inflatable side panel, and disposed between the first inflatable side panel and the second inflatable side panel;

a passageway between the first inflatable side panel and the inflatable tube to allow air to flow from one of the first inflatable side panel and the inflatable tube into the other of the first inflatable side panel and the inflatable tube;

a first valve stem in at least one of the first inflatable side panel or the inflatable tube;

a second valve stem in the second inflatable side panel;

a mesh joined to the first inflatable side panel and the second inflatable side panel, and disposed between the first inflatable side panel and the second inflatable side panel; and a bottom surface joined to the first inflatable side panel and the second inflatable side panel, and disposed between the first inflatable side panel and the second inflatable side panel;

wherein the inflatable tube is enclosed within a volume defined by the first inflatable side panel, the second inflatable side panel, the mesh, and the bottom surface.

12. The pillow of claim 11 wherein the first inflatable side panel and the second inflatable side panel each have a front end and a rear end, the rear end is taller than the front end, and the first inflatable side panel and the second inflatable side panel each have a wedge shape.

13. The pillow of claim 11 wherein the inflatable tube has a front end and a rear end, the rear end is taller than the front end, and the inflatable tube has a wedge shape.

14. The pillow of claim 11 wherein the first inflatable side panel and the second inflatable side panel suspend the tube so that the tube is not in contact with the mesh.

15. The pillow of claim 11 wherein the first inflatable side panel and the second inflatable side panel suspend the tube so that the tube is not in contact with the bottom surface.

16. A pillow, comprising:

a first inflatable side panel;

a first valve stem in the first inflatable side panel;

a second, opposing, inflatable side panel;

a second valve stem in the second inflatable side panel;

an inflatable tube joined to the first inflatable side panel and the second inflatable side panel, and disposed between the first inflatable side panel and the second inflatable side panel;

a third valve stem in the inflatable tube; and a mesh joined to the first inflatable side panel and the second inflatable side panel, and disposed between the first inflatable side panel and the second inflatable side panel;

a bottom surface joined to the first inflatable side panel and the second inflatable side panel, and disposed between the first inflatable side panel and the second inflatable side panel;

wherein the inflatable tube is enclosed within a volume defined by the first inflatable side panel, the second inflatable side panel, the bottom surface, and the mesh.

17. The pillow of claim 16 wherein the first inflatable side panel and the second inflatable side panel each have a front end and a rear end, the rear end is taller than the front end, and the first inflatable side panel and the second inflatable side panel each have a wedge shape.

18. The pillow of claim 16 wherein the inflatable tube has a front end and a rear end, the rear end is taller than the front end, and the inflatable tube has a wedge shape.

19. The pillow of claim 16 wherein the first inflatable side panel and the second inflatable side panel suspend the tube so that the tube is not in contact with the mesh.

20. The pillow of claim 16 wherein the first inflatable side panel and the second inflatable side panel suspend the tube so that the tube is not in contact with the bottom surface.

* * * * *